US005590928A

United States Patent [19]

Voiculescu

[11] Patent Number: 5,590,928

[45] Date of Patent: Jan. 7, 1997

[54] MECHANICAL DOOR STOP

[75] Inventor: Danut Voiculescu, Cleveland, Ohio

[73] Assignee: Winner International Royalty Corporation, Sharon, Pa.

[21] Appl. No.: 456,479

[22] Filed: Jun. 1, 1995

[51] Int. Cl.[6] ..... E05C 3/12

[52] U.S. Cl. ..... 292/338; 292/DIG. 15; 292/178

[58] Field of Search ..... 292/338, DIG. 15, 292/DIG. 19, 306, 177, 178; 16/82, 85, DIG. 10, DIG. 17

[56] References Cited

U.S. PATENT DOCUMENTS

| | | | |
|---|---|---|---|
| 788,950 | 5/1905 | Sargent | 292/178 |
| 917,357 | 4/1909 | Ralston | 292/178 |
| 966,913 | 8/1910 | Hasenpflug | 292/178 |
| 976,597 | 11/1910 | Prevost | 292/178 |
| 982,136 | 1/1911 | Hanson | 292/178 |
| 1,061,592 | 5/1913 | Bommer | 292/178 |
| 1,100,475 | 6/1914 | Franckaerts | 292/69 |
| 1,157,376 | 10/1915 | Franckaerts | 292/69 |
| 1,237,030 | 8/1917 | Haas | 292/178 |
| 1,416,703 | 5/1922 | Force | 292/178 |
| 1,443,570 | 1/1923 | Franckaerts | 292/178 |
| 3,006,676 | 10/1961 | Germock, Jr. | 292/338 |
| 3,024,056 | 3/1962 | Cook | 292/177 |
| 3,347,582 | 10/1967 | Cleff | 292/178 |
| 4,163,574 | 8/1979 | Chezem | 292/338 |
| 4,514,000 | 4/1985 | Chezem et al. | 292/338 |

FOREIGN PATENT DOCUMENTS

| | | |
|---|---|---|
| 1011367 | 5/1977 | Canada . |
| 2228974 | 12/1990 | United Kingdom . |

*Primary Examiner*—Darnell M. Boucher
*Assistant Examiner*—Donald J. Lecher
*Attorney, Agent, or Firm*—Vickers, Daniels & Young

[57] ABSTRACT

An improved doorstop provides increased safety along with the simplified operation over previous doorstops. The doorstop is adapted to be mounted directly to the door in close proximity to an immovable surface such as the floor or a door channel. The device includes a frictional contact member which is leveraged from a first position away from the immovable surface to a second position in frictional contact with the surface. The improved doorstop is useful on sliding doors as well as hinged doors.

26 Claims, 8 Drawing Sheets

MECHANICAL DOOR STOP

FIELD OF THE INVENTION

The present invention relates to a mechanical door stop of the type that limits the opening movement of a hinged or sliding door. More particularly, the present invention relates to a device that can be activated to prevent movement of a door when closed, or to limit further opening of a door that is partially opened. Even more particularly, the present invention relates to a mechanical door stop that may be readily activated, for example by a foot, to prevent movement of a closed or partially closed door. Said door stop can be quickly deactivated by a user to permit free movement of the door.

BACKGROUND OF THE INVENTION

Devices for preventing the opening of a closed door are numerous and varied in design and complexity. These devices range from simple door chains and key activated door locks, slide bolts and padlocks to more sophisticated apparatus. Many devices rely upon the structural integrity of the door device and the door frame for safety, yet an intruder attempting a forced entry can readily overpower many of these devices and gain entry through the door.

One device for limiting the movement of a door from a closed position is a door brace which is pivotally secured at the lower end to the floor and which extends in an angular direction into abutment with the door. The upper end of a door brace is received within a vertically extending slot in the door such that movement of the door from a closed position will urge the upper end of the brace to the top of the slot whereby the brace will contact a stop and thus resist further movement of the door. Such devices, in addition to being visually distracting, tend to extend some distance from the door, thereby presenting a hazardous obstacle to an inattentive person who may inadvertently trip over the brace.

A more recent development in door stops, commercially known as the "Door Club" is a floor mounted device which allows an occupant to prevent or limit the ability of a potential intruder to gain a forced entry through the door. This device comprises a shaft adapted to be slidably received in a tubular receptacle seated within a hole in the floor near the door. The shaft extends upwardly into the pathway of the door, effectively limiting movement of the door. Integral with the shaft are parallel horizontal cross members joined to one another at their ends by two semicircular portions which are parallel to one another but which project horizontally at right angles to the parallel cross members. When the shaft is slid into the receptacle with the semicircular portions extending toward the door, the semicircular portions contact the closed door and prevent opening of the door. By removing the shaft of the door club from the receptacle, rotating it 180° about its axis, and reinstalling it in the receptacle, the door can be opened a small but finite distance for limited viewing and access.

A modification of the Door Club, adapted for use on sliding doors, utilizes a plurality of holes spaced apart along the door track, with the hole closest to the door when in a closed position adapted to co-act with the door stop to prevent any movement of the door when closed. The door may be opened progressively wider by removing the door stop from the first hole and placing it in one of the other holes along the track.

One of the features of the Door Club is the requirement that one or more holes be provided in the floor at or near the closed door. With the relatively widespread use in residential construction of materials such as marble or slate to construct a foyer, builders and homeowners may be reluctant to drill holes through such material for the insertion of a sleeve to receive a door stop.

SUMMARY OF THE INVENTION

The present invention relates to a door stop device for a hinged or a sliding door, said device comprising a means to secure the device to the door in proximity to an immovable surface such as a floor or to a track or channel along which the door moves, a contact surface adapted to frictionally engage the floor or the track, and lever means for moving the contact surface in a linear direction into frictional engagement with the floor or the channel whereby the device serves as a wedge to prevent opening of the door. In one embodiment, the device is used on a hinged door and is mounted on the inside surface thereof near the floor. In another embodiment, the device is mounted on the leading edge of a sliding door, in proximity to the upper or lower channel along which the door glides.

Actuation of the device, by hand or a foot pedal, leverages the contact surface in a linear direction toward the floor or channel, with the linear movement thereof being resisted by a return means such as a compressible spring which serves to return the contact surface to a position away from the floor or the channel upon release. The frictional contact pressure is controllable by activation of the lever means.

The floor contact surface is joined to the bottom of a rod, said rod being moveable in a linear direction toward or away from the floor while simultaneously moving away from or closer to the door. Preferably, the door, the rod and the floor form an open triangle with the rod forming an angle of greater than 15° but less than 75° with respect to the floor. Suitable stop means are provided so that the rod, when the contact surface is spring biased away from the floor or the channel, does not strike and damage the door, but remains spaced a short distance therefrom. The contact surface is preferably comprised of an abrasive material, such as particles of aluminum oxide or the like embedded in a suitable elastomeric or polymeric binder.

In another embodiment of the invention, a security device adapted to be mounted on a hinge door to prevent opening thereof includes a housing and a preferably planar surface moveable into and out of frictional contact with the floor in proximity to the door, said surface pivotally joined to the lower end of an elongated rod. Said rod extends into the housing wherein it is engaged by a leveraging mechanism for urging the friction surface into contact with the floor, and a release mechanism for releasing the rod to return said friction surface to a raised position out of contact with the floor. The leveraging mechanism comprises a lock lever pivotally mounted about a pivot axis within the housing. The lock lever utilizes a biasing means such as a coil spring for maintaining the lock lever in a normal first position about the pivot axis whereby it does not impede linear movement of the rod in either direction. In addition, the lock lever includes means at least partially surrounding the rod for incrementally moving the friction surface toward and into contact with the floor each time the lock lever is pivotally moved from its first position to a second position. The contact pressure is controlled by the person using the device. The release mechanism includes a handle pivotally mounted about a pivot axis within the housing, a biasing means such as a coil spring for maintaining the release handle in a normal first position whereby linear movement of the rod in a vertical direction away from the floor is impeded, and means for pivoting the release handle from said first position to a second position to enable said rod to move freely in said axial direction away from the floor. A third biasing means such as a compressed coil spring, is adapted to urge said rod in an axial direction away from the floor or the channel when the release lever is pivoted to its second position. Preferably, the lock lever is elongated and comprises a first end serving as a hand or foot actuated handle, and a second end pivotally engaging a recess in the housing. The second end preferably is forked or bifurcated to form two arms which pivotally engage two semicircular recesses in the housing, one on either side of the elongated rod. The end of each arm includes a semicircular pivot surface, and the respective surface in the housing includes a semicircular surface for engaging the respective curved surface of each arm of the lever. Each of the coil springs is preferably seated within a suitable recess within the housing, the first coiled spring compressed between the housing and the lock lever, the second coil spring held in compression by the release lever, and the third coil spring surrounding the upper portion of the rod, held in compression between the housing and an annular retention ring or washer joined to the upper end of the rod.

The lock lever cooperates with a wedge plate containing a slot through which the rod passes. The dimensions of the slot permit the rod to move freely when the wedge plate is in its normal at-rest position perpendicular to the rod. However, when the lock lever is actuated, it tilts the wedge plate enough so that the plate is no longer perpendicular to the rod, whereupon the slot in the wedge plate frictionally grips and forces the rod in the linear direction of the floor or channel, moving the rod an incremental linear distance in that direction. Instead of a wedge plate, ratcheting means may be provided to move the friction surface linearly into contact with the floor. The mechanical advantage of the lever can be readily determined by measuring the respective distances of the handle and the wedge plate from the pivot axis or fulcrum of the lever.

In yet another embodiment of the present invention, a security device is used in combination with a closure such as a hinged or sliding door, said device including means to fasten the device to the closure, a contact surface adapted to frictionally engage a floor or channel in proximity to the closure, and lever means for moving the contact surface in a linear direction into frictional engagement with said floor or channel. The device is fastened to the closure on the surface facing the direction in which unwanted movement of the closure is to be prevented, and in proximity to an immoveable surface such as a floor or a channel. The device is fastened at right angles to said immoveable surface. The contact surface is adapted to frictionally engage said immoveable surface at an angle greater than about 15° and less than about 75°, preferably between 30° and 60° with respect to said immoveable surface. Movement of the contact surface by the lever means is resisted by a compressible return means such as a coil spring. The device further includes a release to enable the spring when compressed to move the contact surface away from the immoveable surface.

The contact surface is pivotally joined to one end of a rod. The lever means engages the rod to move the rod toward the moveable surface upon actuation of the lever means. When the closure is a hinged door, the device is preferably mounted on the inside surface of the door in proximity to the floor which is the immoveable surface. On the other hand, when the closure is a sliding door, the device is preferably mounted on the edge of the door in proximity to the door channel, either at the top or at the bottom, either channel serving as the immoveable surface.

One of the objectives of the present invention is the utilization of a security device mounted on a closure such as a hinged door or a sliding door while avoiding the necessity of installing or anchoring any portion of the device to the floor or channel.

Another objective is a door security device that can be readily operated with the foot to activate and to deactivate the device.

Yet another objective is a door-mounted security device which is free of floor-mounted obstructions.

DETAILED DESCRIPTION OF THE INVENTION

This invention relates to a security device useful for securing a closure such as a hinged or a sliding door in a closed or ajar position. When used on a hinged door adapted to pivot about a vertical axis, the device is mounted near the bottom of the door. When used on a sliding door such as a patio door, the device is adapted to be mounted near the top or the bottom of the door, on the edge surface thereof opposite the opening. The device is activated by leveraging it into position against the upper or lower channel, depending upon the location of the device, thereby preventing the door from being moved along the channels to the open position.

In both instances, when used on a hinged door or a sliding door, the device is mounted at an angle whereby its activation creates a wedging effect against an immovable surface thereby strongly resisting efforts at opening the door.

Figure 1:
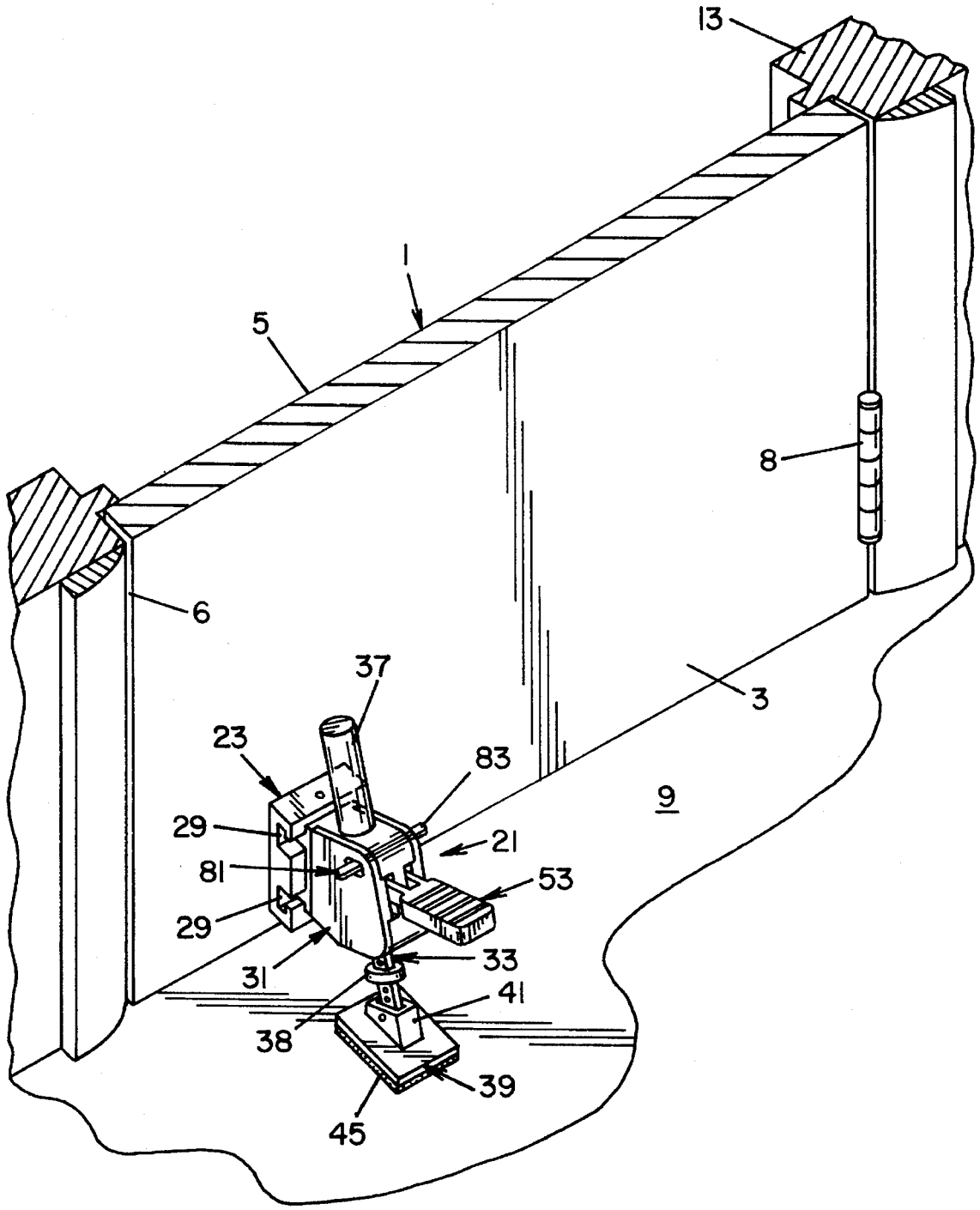
FIG. 1 is a perspective view of a hinged door in the closed position, with the device of the present invention wedged against the floor.
Figure 2:
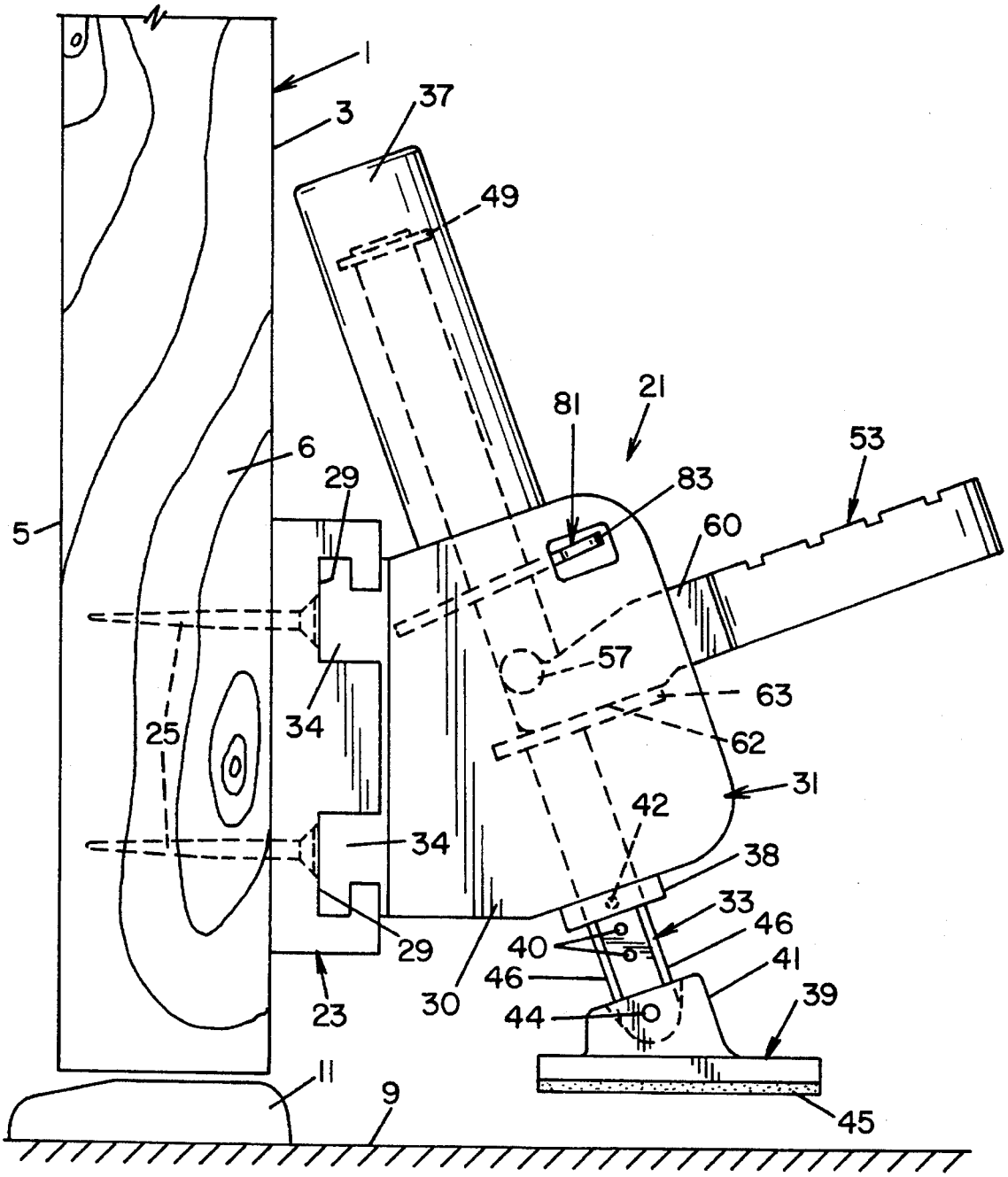
FIG. 2 is an elevational view of a door with the device secured thereto, said device in the elevated non-operative position, portions thereof shown partially in outline.

Referring now in greater detail to the drawings, FIG. 1 shows the lower portion of a door 1 connected to door jam 13 by hinge 8. Joined to the door by mounting plate 23 is the device 21 of the present invention. The device comprises a housing 31 through which extends rod 33 connected at its lower end to shoe 39. In the operative position, the shoe 39 is in frictional contact with floor 9. The rod 33 is leveraged downward into contact with the floor by pedal 53. The shoe is elevated to a non-contacting position upon actuation of release lever 81 using handle 83. Additional details of the device are seen in FIG. 2 showing the door 1 having inner vertical surface 3 and outer vertical surface 5 joined by vertical edge 6. Mounting block 23 is joined to the door by suitable means such as screws 25 (shown in outline). The mounting block includes two horizontal slots 29. Housing 31 contains two horizontal projections 34 which engage the slots 29. Set screw 24 (shown in FIG. 3) secures the device when it is positioned in the mounting block.

Figure 3:
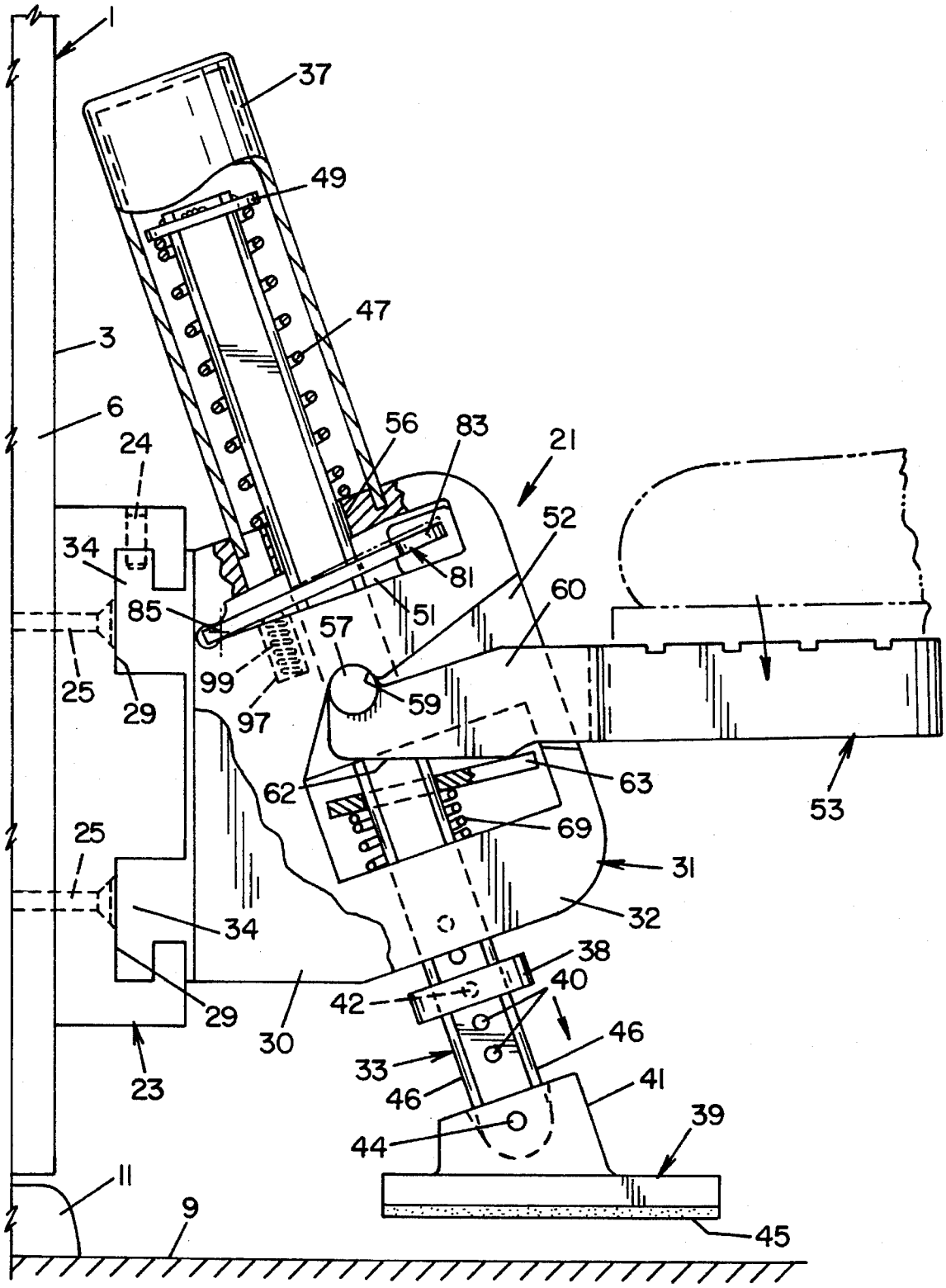
FIG. 3 is an elevational view of the device, in the elevated position, portions thereof shown in cut away views.

FIGS. 2 and 3 show the device in the raised, inoperative position. The device includes elongated rod 33, having lateral edges 46, an upper end extending into cap 37, and a lower end pivotally connected to bracket or boss 41 comprising a portion of the shoe 39. The bottom surface of shoe 39 comprises an abrasive surface 45. The bottom end of the rod 33 contains a plurality of adjustment holes 40. A slotted stop 38 is equipped with a cotter pin 42 or a set screw (not shown) whereby the stop is aligned with one of said holes and is held in place by the cotter pin or set screw. At the very end of the rod 33 is another hole 43 through which a pivot pin 44 extends, to pivotally join the shoe 39 to the rod 33.

Lock lever 53 is equipped with a semi-circular pivot 57 received in a corresponding recess in housing 31. In the normal rest position, the lever is retained in an upward position by a spring 69 shown in FIG. 3. The spring pushes against wedge plate 63 which contacts a planar abutment portion 62 of the lock lever beneath the pivot point 57. As shown in FIG. 2, the wedge plate is at right angles to the direction of axial movement of rod 33. When a downward force such as that exerted by a foot, shown in FIG. 3, is applied to the lever 53, the lever pushes against the wedge plate 63 as shown, to change the angle of the wedge plate with respect to the rod, whereby the wedge plate frictionally grips the lateral edges 46 of the rod and forces the rod downwardly.

Above the lock lever is a release mechanism 81 having handle 83. Spring 99 in blind hole or recess 97 urges the release handle 83 about pivot axis 85. As with the wedge plate, the release handle contains a slot 87 through which rod 33 passes, said slot being slightly larger than and similar to the rod in cross section. With the release handle at right angles to the axis of the rod, the rod moves freely through the slot. However, the spring 91 urges the handle upwardly, thereby causing the angle between the handle and the rod to be slightly less than 90°, whereupon the sides of the slot grip the rod preventing its upward movement.

The device is operated by applying a downward pressure to lock lever 53 whereupon the mechanical leverage is multiplied according to well known principles of physics causing a downward pressure to be exerted against the rod, urging the abrasive surface of the shoe into firm contact with the floor spaced from door stoop 11. As previously noted, the movement of the lock lever changes, slightly, the angle of the wedge plate with respect to the rod thereby gripping the rod and forcing it down toward the floor. Movement in this downward direction does not affect the operation of the release mechanism 81. However, the release handle 83 in its normal at-rest position prevents upward movement of the rod 33. The release mechanism 81 is actuated by pushing down on the release handle 83 to unbind the rod whereupon return spring 47, compressed between the annular washer 49 and retainer groove 56, urges the rod upward away from the floor. Another spring 69 surrounding the rod 33 is biased between the housing 31 and the wedge plate 63 thereby serving to urge the wedge plate and the lock lever 53 into an elevated, at-rest, position.

Figure 4:
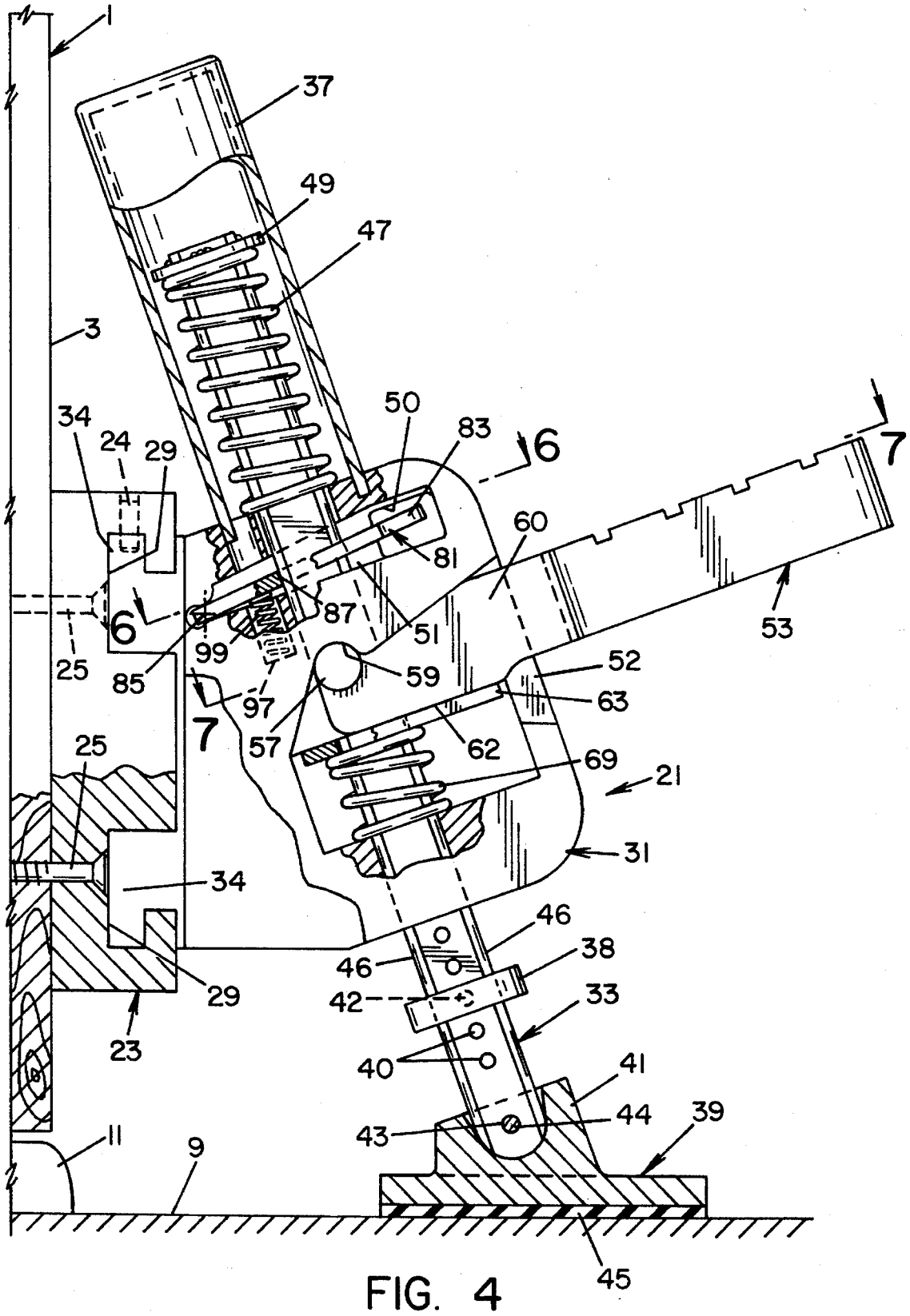
FIG. 4 is a view similar to that of FIG. 3 with the device shown in the operative position, with portions thereof shown in cross-sectional view for clarity.
Figure 5:
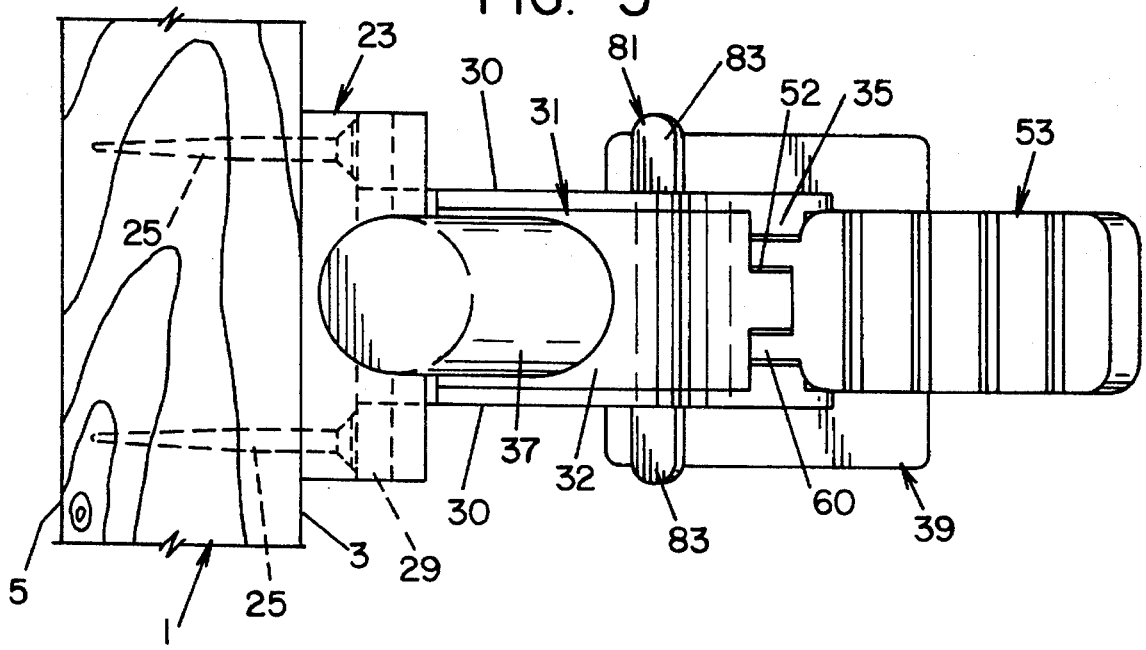
FIG. 5 is a top view of the device shown in FIGS. 3 and 4.
Figure 6:
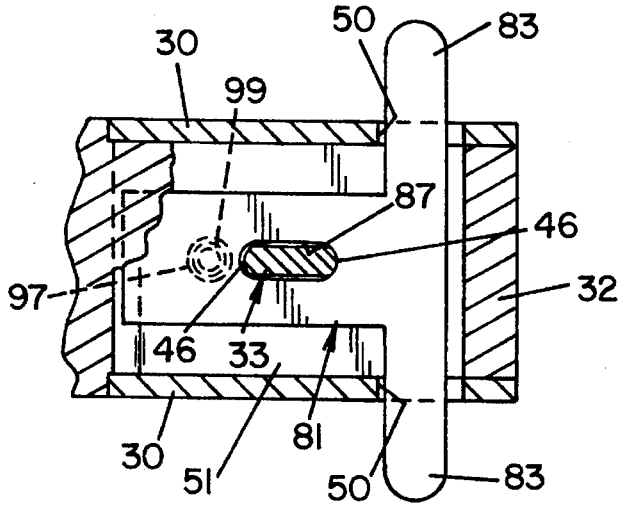
FIG. 6 is a view taken along lines 6—6 of FIG. 4.

FIG. 4 shows the abrasive surface 45 of the shoe 39 in contact with the floor 9. The force exerted by this shoe against the floor is dependent upon the amount of force applied to the lock lever and the angle between the rod and the floor. The angle that the rod forms with respect to the door is greater than 0° preferably greater than 15° but less than 75°. There are at least two factors that enter into the determination of this angle. In the first place, the upward movement of the rod is toward the door. Accordingly, the angle must be such that the top of the rod will not contact the door when the shoe is raised from the floor. Another factor is the ability of the abrasive surface on the bottom of the shoe to resist sliding along the floor when an attempted forced entry causes horizontal and vertical components of the force to be applied against the shoe. For example, as the angle between the rod and the floor approaches 90°, there is a corresponding decrease in the ability of the abrasive surface to grip the floor when such force is applied to the door. Likewise as the angle between the rod 33 and the floor 9 approaches 0°, a relatively small pressure against the door in a horizontal direction can cause the shoe to buckle, losing its grip on the surface of the floor. Thus, the rod is mounted in the device to form an angle between about 15° and 75° with respect to the floor, with an angle between about 30° and 60° being preferred.

Figure 7:
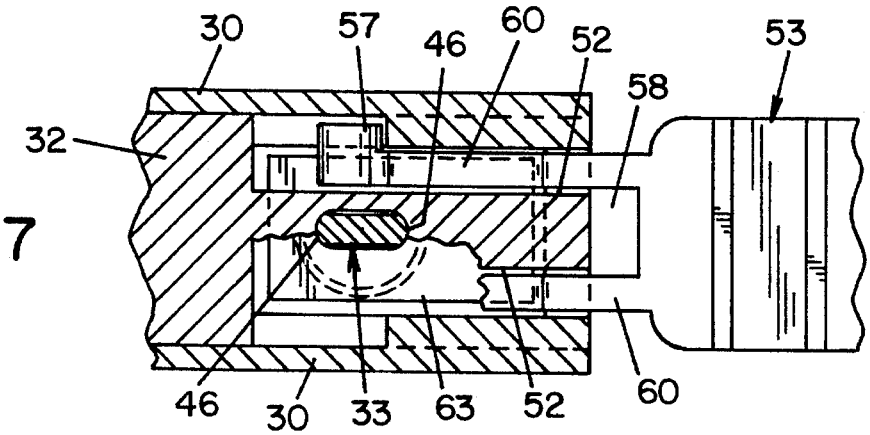
FIG. 7 is a view taken along lines 7—7 of FIG. 4.
Figure 8:
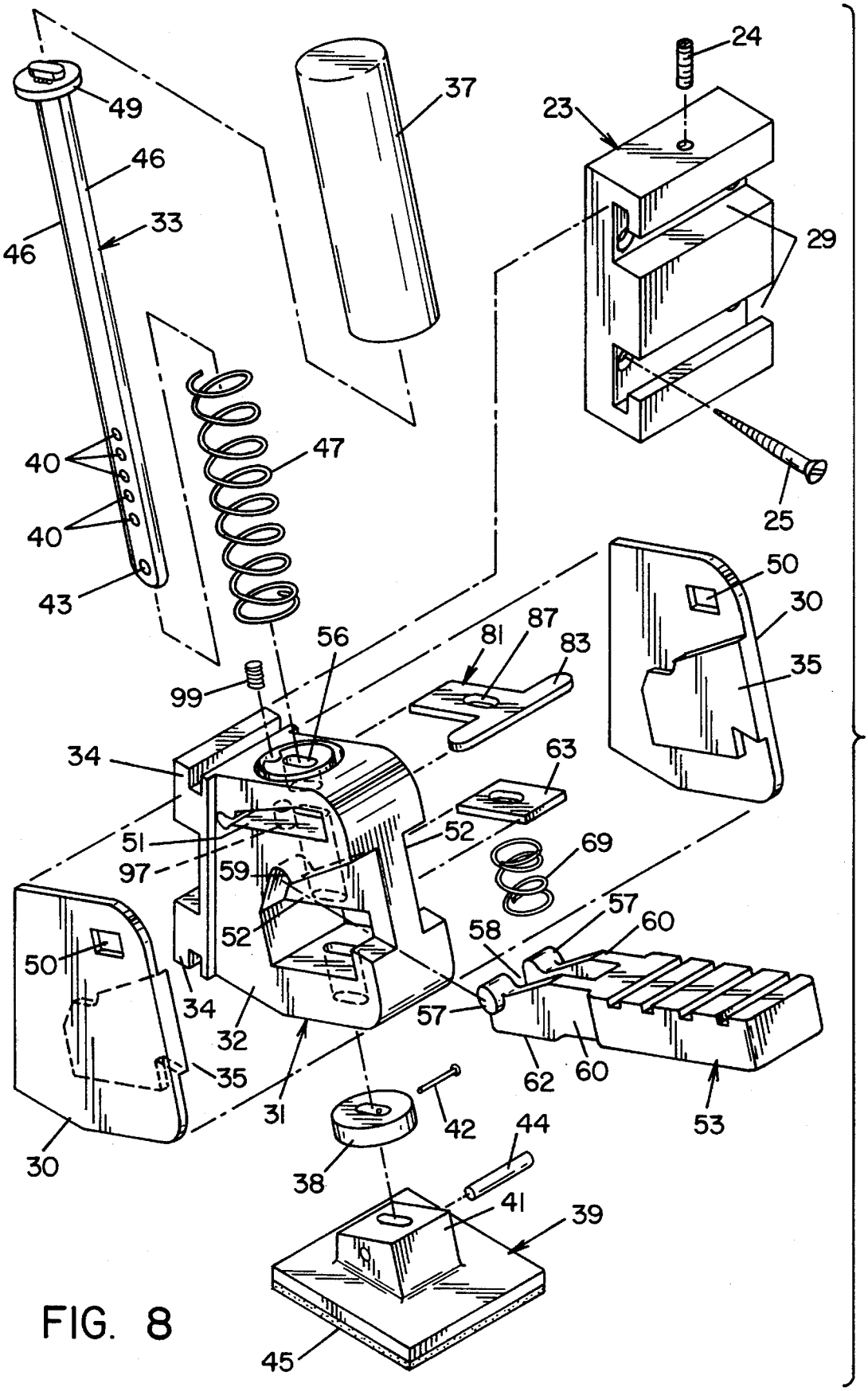
FIG. 8 is an exploded perspective view of the device of the present invention.
Figure 9:
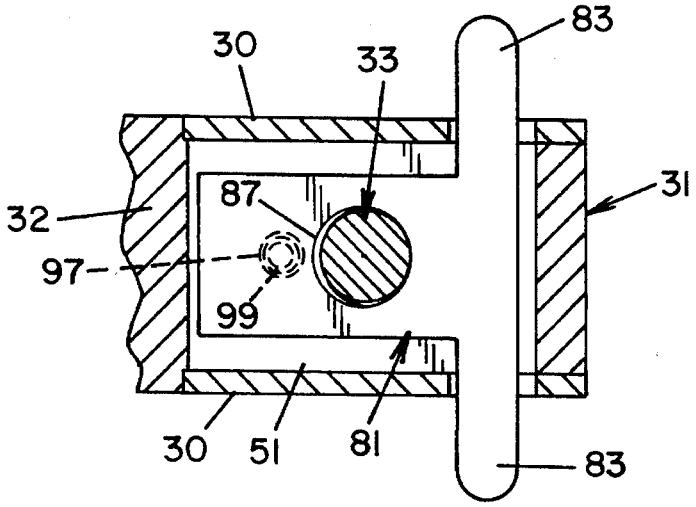
FIG. 9 is a view similar to the cross-sectional view of FIG. 6, showing another embodiment of the invention.

Additional features of the present invention are shown in FIG. 8 which is an exploded view of the device. Although the device may be assembled in any number of ways, one simplified embodiment is shown therein. This embodiment includes a housing block 32, and housing end plates 30. The housing block 32 contains a pair of recesses 52 adapted to receive lock lever 53. As shown in this figure as well as FIG. 7, lock lever 53 includes two arms 60 forming a slot 58 there between, each arm engaging one of the housing recesses 52. Each of the arms terminates in a semi-circular pivot 57. Each pivot engages one of the semi-circular surfaces 59 in recess 52. Each of the end plates 30 contains a projection 35 conforming generally to the contour of the recess 52 to form a close fit. Abutment surface 62 of lock lever 53 is in planar contact with wedge plate 63.

Slot 51 extending horizontally through housing block 32 is adapted to receive the release mechanism 81. As previously described, release spring 99 fits into spring recess 97 to urge the release mechanism upwardly, the upward movement being limited by the vertical width of the slot 51. Holes 50 in each of the end plates 30 are adapted to receive the handle 83 of the release mechanism.

Figure 10:
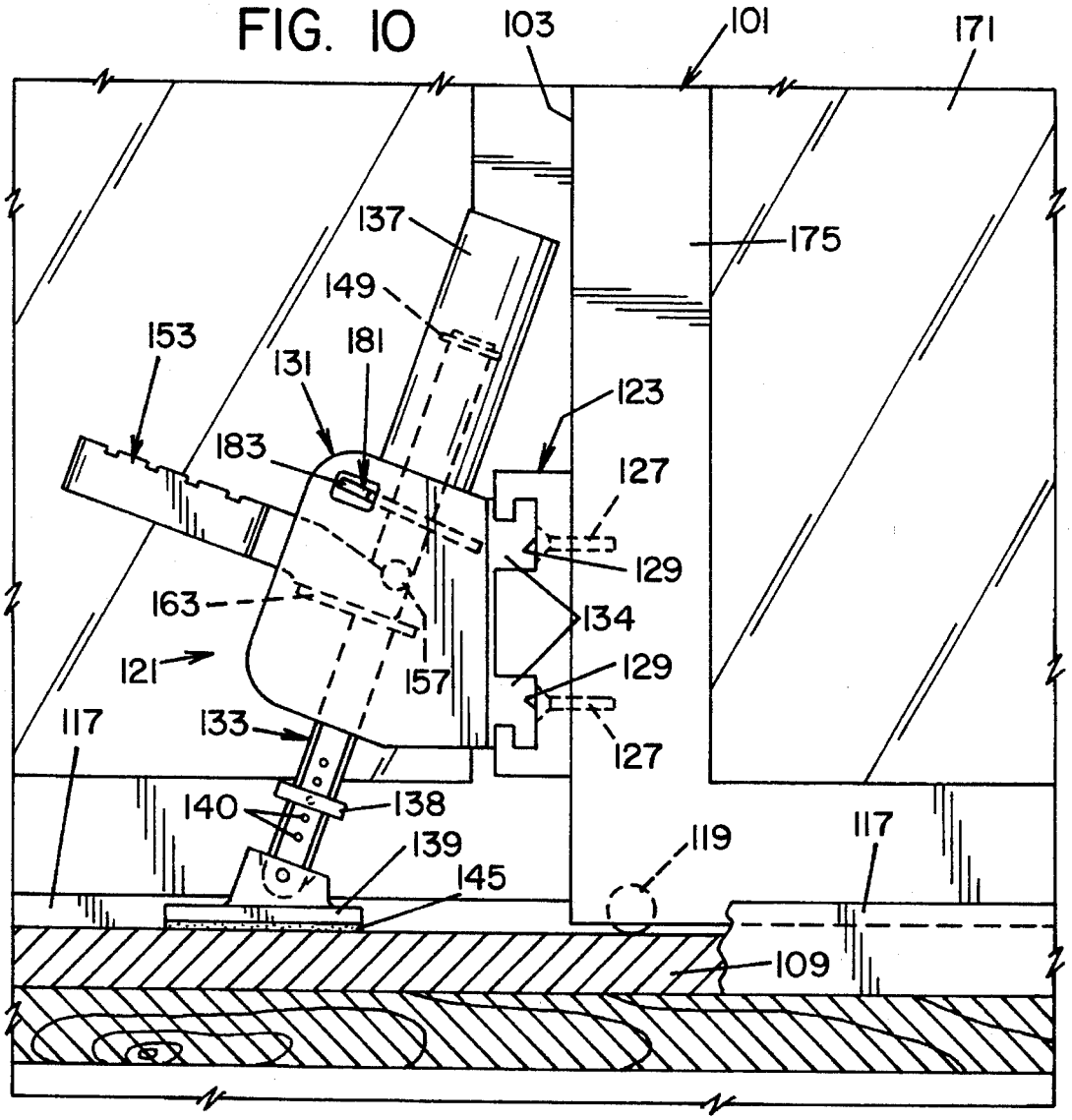
FIG. 10 is a view of the device mounted on a sliding door, portions of the device shown in outline.
Figure 11:
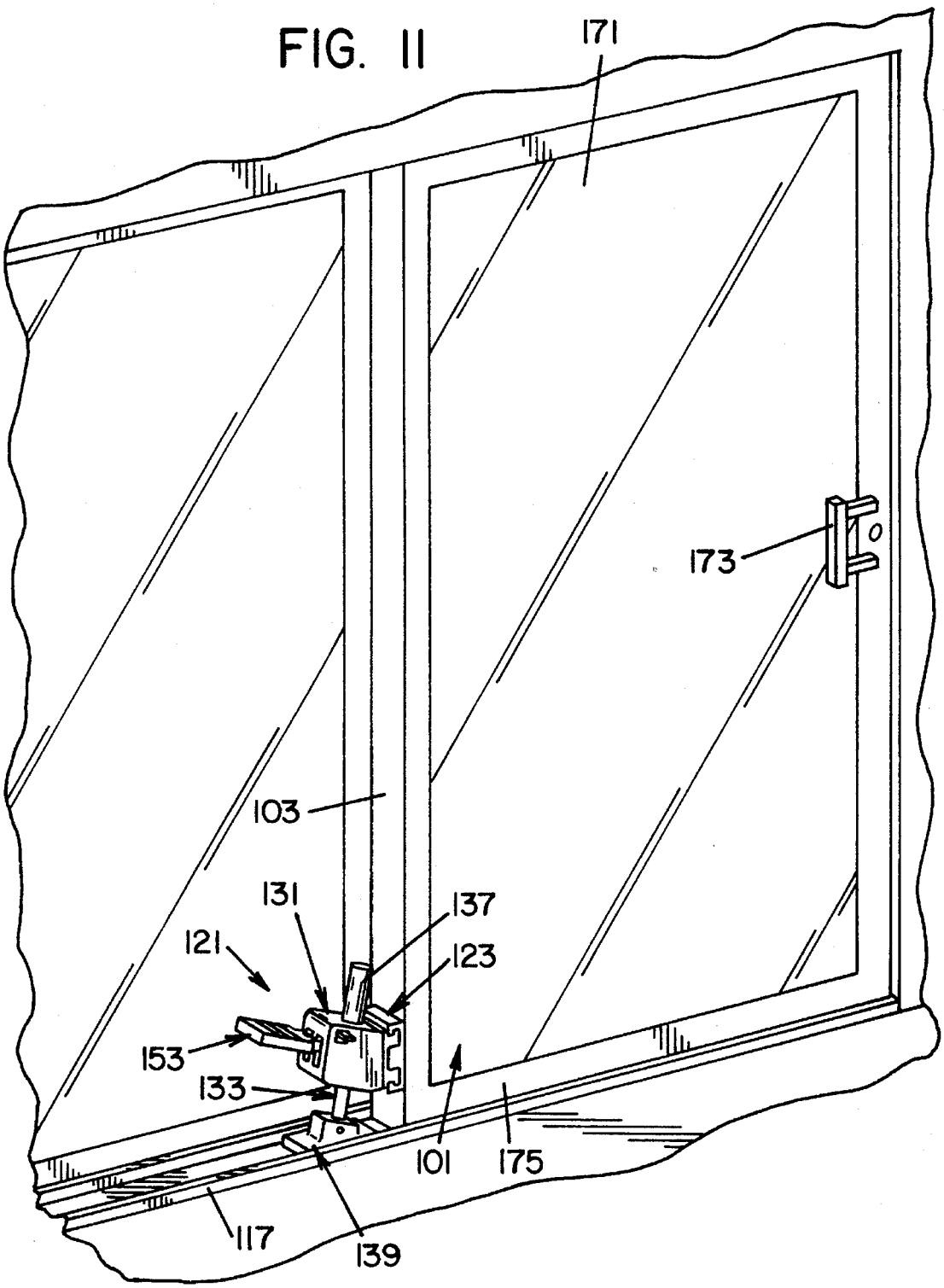
FIG. 11 is a perspective elevational view of the sliding door of FIG. 10 with the device mounted thereon.

FIGS. 10 and 11 show another embodiment of the present invention wherein the device is adapted to be mounted on the top or bottom leading edge of a sliding door such as a patio door. As noted in reference to FIG. 11, a standard sliding glass door 101 of the type commonly used in residences for access to patios and decks is shown engaging a channel 117. The channel is typically made as an extrusion from a metal such as aluminum. The door comprises a door frame 175 enclosing a pane of tempered glass 171. A handle 173 is used to open and close the door as needed. The device 121 of the present invention is shown mounted to the edge 103 of the door.

Referring more particularly to FIG. 10, the device 121 includes a housing 131 secured to the door 101 by mounting plate 123 using screws inserted into holes 127. Slots 129 in the mounting plate accommodate the projections 134. As shown before, the device comprises a foot actuated lock lever 153 having limited rotation about pivot axis 157, said lever contacting wedge plate 163. Rod 133 has shoe 139 pivotally joined to the lower end thereof, said shoe having a frictional surface 145. In the secured position, the surface 145 contacts floor 109 at a contact angle that strongly resists any effort to open the door.

The rod 133 extends through the device and is held against upward movement by a release mechanism 181 through which the rod 133 extends. The operation of the device shown in FIG. 10 is the same as that previously described in connection with FIGS. 1–9, but the arrangement of the springs and wedge plate is omitted from the views for simplification. Nonetheless, when the handle 183 of mechanism 181 is pushed downwardly a compressed spring (not shown) within cap 137 pushes against annular washer 149, urging rod 133 upwardly, thereby raising the shoe 139 from its frictional engagement with channel 117. Upward movement is limited by stop 138 at the bottom of the rod 133. The position of the stop 138 can be adjusted by the use of a pin or set screw aligned with one of the holes 140 in the rod 133. With the shoe elevated out of the channel, the door 101 can then glide by one or more rollers 119 along the channel.

The locking device of the present invention is fabricated from materials which will withstand the stresses likely to be imposed on the device during an attempted forced entry. For example, the housing block, the end plates, the lock lever, the mounting plate and the shoe may be fabricated from a suitable thermosetting polymeric material such as polypropylene, a rigid polyurethane or polycarbonate. The pieces may be molded into shape or may be machined from solid blocks to conform with the dimensional limitations of the device. The three springs preferably are fabricated from spring steel. The rod preferably is machined from steel, steel alloy, aluminum or other suitable metal. The annular washer at the top as well as the stop washer in the bottom may be made of metal or polymer as appropriate. The wedge plate and release handle are produced from a material that is compatible with the rod, preferably metal. It is contemplated that regular flat head metal screws are used to affix the mounting plate to the door.

Typically, the end plates are secured to the housing block utilizing a suitable water or solvent base cement, or by bonding using a process such as ultra-sonic heating. The end plates are secured in place after the rod, levers, springs and wedge plate are assembled into the housing block.

It is also contemplated as being within the scope of the present invention that the mounting plate, housing block and other components such as the lock lever can be fabricated from a suitable metal such as aluminum. These component parts may be produced by casting. However, more typically, the parts may be formed into shape by machining or other metal working procedures with the requisite tolerances for fit. The component parts could be assembled using fasteners such as machine bolts or the like.

Having thus described the invention, it is claimed as follows:

1. In combination with a security device adapted to be mounted on a hinged door to prevent opening thereof, said device including a housing, a planar friction surface movable into and out of frictional contact with the floor in proximity to the door, said friction surface joined to the lower end of an elongated rod, said rod extending into and through the housing, a leveraging mechanism for actuating the rod to urge the friction surface into pressure contact with the floor and for releasing the rod to return said friction surface to a position out of contact with the floor, said leveraging mechanism comprising:

(a) a lock lever pivotally mounted about a pivot axis within said housing and including:

(1) first biasing means for maintaining said lock lever in a normal first position about said pivot axis whereby axial movement of said rod is not impeded; and (2) means at least partially surrounding the rod for incrementally moving said friction surface toward and into contact with the floor each time said lock lever is pivotally moved from said first position to a second position;

(b) a release mechanism including a (1) a release handle pivotally mounted about a pivot axis within said housing and including:

(2) second biasing means for maintaining the release handle in a normal first position whereby axial movement of the rod in a vertical direction away from the floor is impeded; and (3) means to permit the release handle to be pivoted from said first position to a second position whereby said rod is free to move in an axial direction away from the floor;

(c) third biasing means adapted to urge said rod in an axial direction away from the floor when said release handle is pivoted to its second position.

2. In the combination of claim 1, said lock lever being elongated and including a first end serving as a hand or foot actuated handle and a second end pivotally engaging a recess in the housing.

3. In the combination of claim 2, said second end of said lock lever being bifurcated to form two arms, each arm separately engaging a recess in the housing on one side of the rod.

4. In the combination of claim 3, each of said arms including a semi-circular pivot surface, and each said recess including a semi-circular surface to receive the pivot surface of one arm.

5. In the combination according to claim 4, the lock lever biasing means comprising a coiled spring compressed between the housing and the lock lever.

6. In the combination according to claim 5, said rod passing through said coiled spring, said spring having one end abutting a planar surface of a wedge plate.

7. In the combination according to claim 6, said lock lever engaging a second planar surface of the wedge plate parallel to said first surface.

8. In the combination according to claim 6, said rod having a generally rectangular cross-section, and said wedge plate including a corresponding slot through which the rod passes, said slot being sized to permit the rod to pass freely therethrough when said lock lever is in the first position.

9. In the combination according to claim 8, said slot being sized whereby movement of the lock lever handle from the first position to the second position causes the wedge plate to grip and move the rod in a downward direction.

10. In the combination according to claim 9, the release handle containing a slot through which the rod passes, said slot being sized to frictionally engage the rod when said release lever is in the first position, thereby preventing upward movement of said rod.

11. In the combination according to claim 10, said device further including a second coiled spring in compression, said spring having a first end seated in the housing, and a second end in contact with said release handle thereby maintaining said lever in said first position.

12. In the combination according to claim 11, the slot in said release handle permitting movement of the rod axially in either direction when said lever is pivotally moved into said second position.

13. In the combination according to claim 12, said release handle having the pivot axis at one end thereof, manipulating means at the other end thereof, said slot through which a rod passes being intermediate the two ends.

14. A doorstop device comprising: (a) means adapted to secure the device to the bottom of a vertical surface of a door in proximity to an immovable surface such as a floor; (b) a rod and a contact surface, said contact surface joined to one end of the rod, and adapted to be moved into and out of frictional contact with the immovable surface; (c) a leveraging mechanism including a lock lever pivotally mounted about a pivot axis for moving the rod angularly away from the vertical door surface and moving the contact surface into engagement with the immovable surface with a controllable pressure to effectively prevent movement of the door in the direction of the doorstop, said lock lever including a first biasing means for maintaining the lock lever in a normal first position which does not impede the movement of said rod, said lock lever including means to incrementally move said rod and said contact surface toward the immovable surface as the lever is pivotally moved about its pivot axis from a first position to a second position, and return means comprising a release handle and spring means, said spring means serving to bias the contact surface away from the immovable surface when the release handle is actuated.

15. The device according to claim 14, wherein the rod is positioned whereby linear movement of the rod is in a first vertical plane generally parallel to the door as the device is mounted on the door, and a second plane orthogonal to the first plane at an angle between about 15° and about 75° with respect to the door whereby upward movement of the rod moves the rod diagonally toward the door and downward movement moves the rod diagonally away from the door.

16. The device according to claim 14 wherein the contact surface is adapted to frictionally engage the immovable surface at an angle between about 15° and about 75°.

17. The device according to claim 14 wherein the lock lever at least partially surrounds the rod.

18. The device according to claim 17 wherein the lock lever is elongated and includes a first end serving as a handle and a second end forming a pivot, said lever being bifurcated to form two arms with the rod movable in a linear direction between said arms.

19. The device according to claim 18 further including a housing through which the rod passes, said housing adapted to be secured to the vertical surface of the door.

20. The device according to claim 19 wherein the housing contains recess means forming a pivot axis engaging the second end of the lock lever.

21. The device according to claim 14 further including a shoe pivotally joined to one end of the rod, and the contact surface comprises an abrasive material on a surface of the shoe adapted to contact the immovable surface.

22. The device according to claim 14 wherein the lock lever is elongated and includes a first end serving as a handle and a second end forming a pivot, the lock lever engaging and moving a wedge plate when the lock lever is pivoted from its first to its second position, whereby movement of said wedge plate grips and moves the rod in a linear direction toward the immovable surface.

23. The device according to claim 14 wherein the spring means comprises a spring held in compression when the contact surface is in contact with the movable surface.

24. The device according to claim 23 wherein the release handle is moveable about a pivot axis between a normal first position in frictional engagement with said rod to prevent movement of the contact surface away from the immovable surface and a second position permitting said spring to move the contact surface away from the immovable surface, the release lever being maintained in the normal first position by second biasing means.

25. The device according to claim 14 wherein the door is a hinged door and the device is adapted to be mounted on the inside planar surface thereof in proximity to a floor, said floor comprising the immovable surface.

26. The device according to claim 14 wherein the door is a sliding door and the device is adapted to be mounted on a vertical edge of the door in proximity to the door channel, said channel comprising the immovable surface.

* * * * *